US006305984B1

(12) United States Patent
Katoh et al.

(10) Patent No.: US 6,305,984 B1
(45) Date of Patent: Oct. 23, 2001

(54) ELECTRICAL CONNECTOR

(75) Inventors: Satoshi Katoh; Takeshi Okuyama; Manabu Shimizu, all of Tokyo (JP)

(73) Assignee: Fujitsu Takamisawa Component Ltd., Tokyo (JP)

( * ) Notice: Subject to any disclaimer, the term of this patent is extended or adjusted under 35 U.S.C. 154(b) by 0 days.

(21) Appl. No.: 09/452,197

(22) Filed: Dec. 2, 1999

(30) Foreign Application Priority Data

Jun. 15, 1999 (JP) ..... 11-168396

(51) Int. Cl.[7] ..... H01R 13/648
(52) U.S. Cl. ..... 439/607; 439/108
(58) Field of Search ..... 439/607–610, 439/79

(56) References Cited

U.S. PATENT DOCUMENTS 5,637,014 * 6/1997 Sukegawa et al. ..... 439/607
5,685,739 * 11/1997 Davis et al. ..... 439/607
5,928,035 * 7/1999 Jankowski et al. ..... 439/607
5,938,473 * 8/1999 Nishio et al. ..... 439/607
5,993,258 * 11/1999 Matsunuma et al. ..... 439/607
6,123,583 * 9/2000 Huang ..... 439/607

FOREIGN PATENT DOCUMENTS 6-196225 7/1994 (JP) .

* cited by examiner

*Primary Examiner*—Hien Vu
(74) *Attorney, Agent, or Firm*—Staas & Halsey, LLP

(57) ABSTRACT

A cable connector having a contact terminal member, a housing formed from a single sheet of metal having top, side wall and bottom portions so as to form a box enclosing the contact terminal member, a cable connector insertion port formed at a front end of the housing, and a plurality of integrated legs integrally formed with the housing and disposed so as to extend in a downward direction from side rear edges of the bottom portion of the housing, the integrated legs to be inserted in a plurality of holes formed on a printed circuit board, the connector having a front integrated leg integrally formed with the housing and disposed so as to extend in a downward direction from a bottom edge of the cable connector insertion port, the front integrated leg to be inserted in a hole formed on the printed circuit board so as to fixedly mount a front end of the connector on the printed circuit board.

7 Claims, 11 Drawing Sheets

ELECTRICAL CONNECTOR

BACKGROUND OF THE INVENTION

1. Field of the Invention

The present invention relates generally to an electrical connector formed from a single sheet of metal, and more particularly, to a Universal Serial Bus (USB) connector that is a serial interface connecting telephones, keyboards and other such peripheral equipment to a computer, the USB connector having improved mechanical stability and rigidity and providing effective protection against electromagnetic interference.

2. Description of the Related Art

To facilitate an understanding of the conventional art, a description will first be given of the relation between the way the generally rectangular-shaped USB connector is fitted to a printed circuit board and the need for efficient use of the limited space available on the printed circuit board itself.

Specifically, positioning the USB connector atop the printed circuit board so that the longer side of the USB connector Is vertical, that is, perpendicular to the surface of the printed circuit board, requires less space for mounting the USB connector on the printed circuit board than a case in which the longer side of the USB connector is horizontal, with the USB connector therefore mounted on the printed circuit board in that horizontal position. As a result, the printed circuit board, which has a limited size, can be utilized more effectively.

However, positioning the USB connector so that the longer side is vertical, that is, vertically mounting the USB connector, though desirable for efficient utilization of the printed circuit board, is less mechanically stable than when the longer side of the USB connector is horizontal and thus directly mounted on the printed circuit board, that is, when the USB connector is mounted horizontally.

Additionally, a force exerted on the USB connector toward the rear thereof when a cable connector is inserted in the USB connector can be very great, requiring heightened mechanical stability of the mounting of the USB connector on the printed circuit board when the USB connector is mounted in such a way that the longer side of the USB connector is vertical, that is, vertically mounted.

Additionally, the cable itself may be accidentally pulled or wrenched in one or another direction, thus straining the connection with the USB connector in a lateral direction as well and possibly loosening the connection of the USB connector to the printed circuit board, which is undesirable. Therefore there is a need for a USB connector with Improved lateral mechanical stability as well.

Additionally, the height of the USB connector above the printed circuit board when the USB connector is mounted vertically is of course greater than when the USB connector is mounted horizontally on the printed circuit board. If the USB connector is mounted on the printed circuit board so as to lie at an angle to the printed circuit board, though that angle may be the same for both a vertically mounted USB connector and a horizontally mounted USB connector, the top edge of the housing of the vertically mounted USB connector will nevertheless project further towards a cable connector opening in a side wall portion of a device in which such USB connector is installed than would a horizontally mounted USB connector simply because of the greater length of the vertical side of the USB connector. As a result, there is a possibility that the USB connector may come into direct contact with such side wall portion of the device, thus generating interference and degrading the electrical connection. Therefore there is a need to eliminate or at least minimize any such leaning of the USB connector when mounting the connection of the USB connector to the printed circuit board.

To further facilitate an understanding of the conventional art, a description will now be given of a conventional USB connector, with reference to FIGS. 1A and 1B. For convenience of explanation, in the drawings the X1–X2 axis represents the lateral or horizontal dimension, the Z1–Z2 axis represents the longitudinal or vertical dimension and the Y1–Y2 axis represents the depth front-to-rear dimension.

FIGS. 1A and 1B are diagrams of a conventional USB connector. In FIG. 1A, the conventional USB connector 1 is shown opposite a cable connector 10 which is attached to the end of a cable. The USB connector 1 is a right-angle type connector, and consists of an insulation panel 2 and a plurality of right-angle contact terminals 3 inserted within a sheet metal housing 4. The sheet metal housing 4 is formed from a single piece of sheet metal folded into a substantially box-like shape. Legs 4*a* are formed at a rear Y1 side of the sheet metal housing 4.

This USB connector is mounted atop a printed circuit board 15 as shown in FIG. 1B by inserting the legs 4*a* and the tip portions 3*a* of the downward-facing tips of the contact terminals 3 into holes 16, 17 in the printed circuit board 15 and soldering them thereto. A cable connector insertion port 5 of the USB connector 1 is open to an opening (not shown in the diagram) in the side of the device. The cable connector 10 passes through this opening in the side of the device and is inserted in and thereby connected to the cable connector insertion port 5 of the USB connector 1.

When mounted, the USB connector is fixed only at the rear Y1 side but not at a front Y2 side at which the cable connector insertion port 5 is formed. The USB connector is therefore not well balanced, and additionally, the cable connector insertion port 5 lacks the requisite stability and rigidity to retain its level position atop the printed circuit board 15.

As a result, when connecting the cable connector 10 the cable connector insertion port 5 of the USB connector may be pushed and separated from the surface of the printed circuit board 15. Moreover, the cable connector insertion port 5 of the housing 4 may be deformed or may widen when wrenching or twisting movements accompany the connection of the cable connector 10.

Additionally, because the legs 4*a* of the USB connector 1 are positioned only at the rear Y1 side of the USB connector 1, when mounted provisionally the USB connector 1 has a tendency to tilt toward the front due to the force of gravity as shown in FIG. 1B. The USB connector 1 must therefore be made level prior to soldering, a requirement that slows the speed with which the USB connector 1 can be mounted on the printed circuit board 15.

SUMMARY OF THE INVENTION

Accordingly, it is an object of the present invention to provide an improved and useful electrical connector having improved mechanical stability and providing effective protection against electromagnetic interference, in which the disadvantages described above are eliminated.

The above-described object of the present invention is achieved by a connector having a contact terminal member, a housing formed from a single sheet of metal having top, side wall and bottom portions so as to form a box enclosing the contact terminal member, a cable connector insertion port formed at a front end of the housing, and a plurality of integrated legs integrally formed with the housing and disposed so as to extend in a downward direction from side rear edges of the bottom portion of the housing, the integrated legs to be inserted in a plurality of holes formed on a printed circuit board, the connector comprising:

a front integrated leg integrally formed with the housing and disposed so as to extend In a downward direction from a bottom edge of the cable connector insertion port, the front integrated leg to be inserted in a hole formed on the printed circuit board so as to fixedly mount a front end of the connector on the printed circuit board.

Additionally, the above-described object of the present invention is also achieved by the connector as described above, wherein the connector has a plurality of front integrated legs extending downward from the bottom edge of the cable connector insertion port, the integrated legs being inserted in a plurality of holes formed on the printed circuit board so as to fixedly mount the front end of the connector on the printed circuit board.

According to the invention described above, by placing one or more legs at the front as well as at the back of the USB connector, it is possible to fixedly mount not only the rear side but also the front side, that is, the cable connector insertion port side, of the USB connector to the printed circuit board, thereby improving the overall balance of the USB connector-printed circuit board connection so that it does not come loose from the surface of the printed circuit board, and in particular strengthening the rigidity of the cable connector insertion port side of the USB connector. As a result, it is possible to carry out the work of inserting and connecting the cable connector to the cable connector insertion port with greater speed, ease and reliability. At the same time, it is also possible to prevent the metal housing from being deformed or the cable connector insertion port from widening during insertion of the cable connector.

Additionally, the above-described object of the present invention is also achieved by the connector as described above having a double bottom portion comprising an upper bottom portion and a lower bottom portion of the housing reinforcingly disposed so as to engage each other.

Additionally, the above-described object of the present invention is also achieved by the connector as described above, wherein a free edge of the lower bottom portion is bent upward and then backward so as to have a substantially C-shaped cross section, an upper part of the C-shaped cross section engaging a slot formed in a side wall portion of the housing.

Additionally, the above-described object of the present invention is also achieved by the connector as described above, a front edge of the upper bottom portion extending beyond the bottom edge of the cable connector insertion port and then bent downward and rearward so as to form a flap portion which extends rearward along an outer surface of the lower bottom portion, a tip portion of the flap portion being formed into an integrated leg extending downward therefrom, the integrated leg to be inserted in a hole formed in the printed circuit board so as to fixedly mount the front end of the connector on the printed circuit board.

Additionally, the above-described object of the present invention is also achieved by the connector as described above, wherein the flap portion has flange portions on either side thereof, the flange portions being bent upward so as to extend along an outer surface of both side wall portions of the housing.

According to the invention described above, the mechanical stability and rigidity of the connector can be improved.

Additionally, the above-described object of the present invention is also achieved by a method for manufacturing a housing for a connector from a single sheet of metal by folding the sheet so as to form a box.

Additionally, the above-described object of the present invention is also achieved by the connector as described above, wherein the connector is a Universal Serial Bus (USB) connector.

Other objects, features and advantages of the present invention will become more apparent from the following detailed description when read in conjunction with the accompanying drawings.

DESCRIPTION OF THE PREFERRED EMBODIMENTS

A description will now be given of embodiments of the present invention, with reference to the accompanying drawings.

Figure 1A:
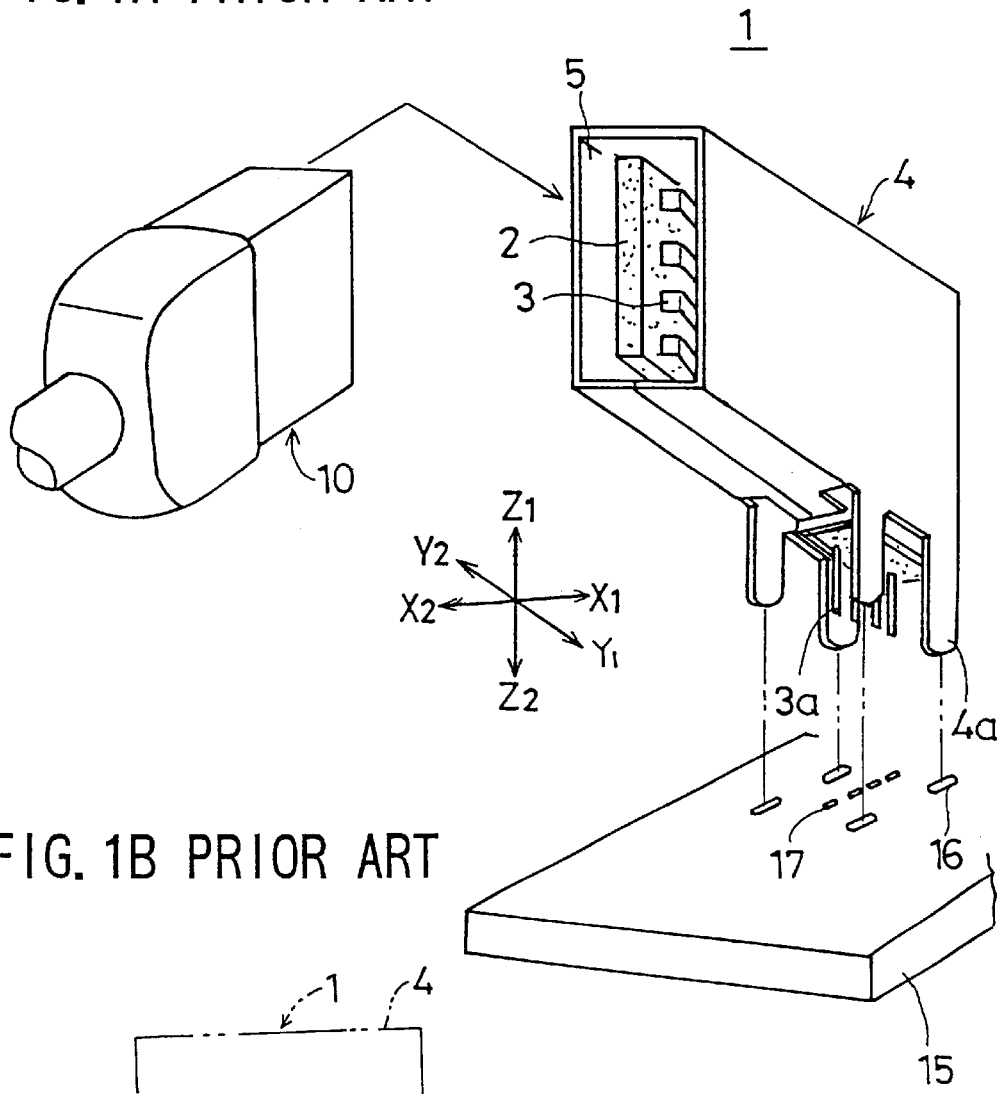
FIG. 1A PRIOR ART
FIGS. 1A and 1B are diagrams of a conventional USB connector.
Figure 1B:
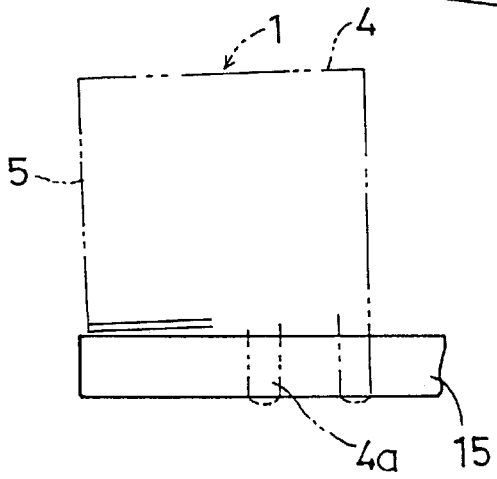
FIG. 1B PRIOR ART
Figure 2:
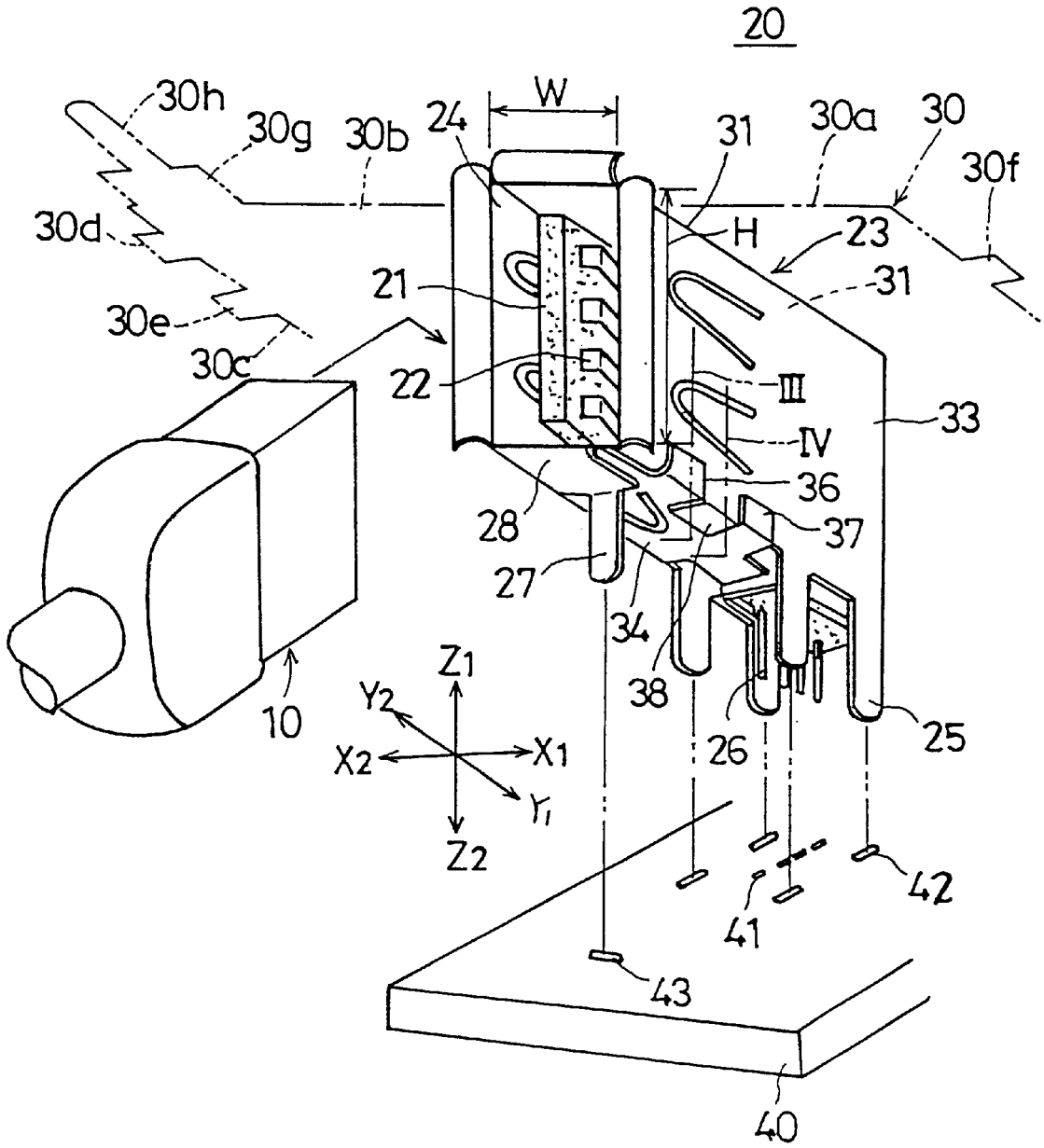
FIG. 2 is a diagram of a first embodiment of a USB connector according to the present invention.

FIG. 2 shows a first embodiment of a USB connector 20 according to the present invention, together with a cable connector 10.

The USB connector 20 is a right-angle connector type, with an insulation member 21 and four right-angle connection terminal members 22 contained within a substantially rectangular sheet metal housing 23 having electromagnetic shielding properties.

Reference numeral 24 is a cable connector insertion port, and is provided on a front Y2 side of the USB connector 20. Two legs are provided on a left X2 side and on a right X1 side of a bottom portion of the USB connector 20 near a rear Y1 side thereof, for a total of four legs 25. These four legs 25 as well as four terminals 26 project downward in a Z2 direction from the bottom portion of the USB connector 20. In addition, a fifth leg 27 which similarly projects downward is located near a front Y2 side of the USB connector 20. It is this forward fifth leg that comprises the chief innovation of the present invention.

The metal housing 23 is formed by folding a single sheet of metal 30 having a shape indicated by the dotted-and-dashed lines in FIG. 2, and comprises a top portion 31, left and right side wall portions 32 and 33, respectively, and bottom portions 34. A height H of the side wall portions 32 and 33 is several times greater than a width W of the top and bottom portions 31 and 34. The metal sheet 30 indicated by the dotted-and-dashed lines is shown in the diagram so that a top portion thereof exactly coincides with the top portion 31, and further comprises preformed right and left side wall portions 30*a* and 30*b* as well as a preformed bottom portion 30*c*. The metal housing 23 is folded such that the X1 edge of the bottom portion and the Z2 edge of the right side wall portion 33 meet.

The metal sheet 30 may for example have a thickness of 0.3 mm, and may be a solder-coated phosphor bronze sheet.

Figure 3:
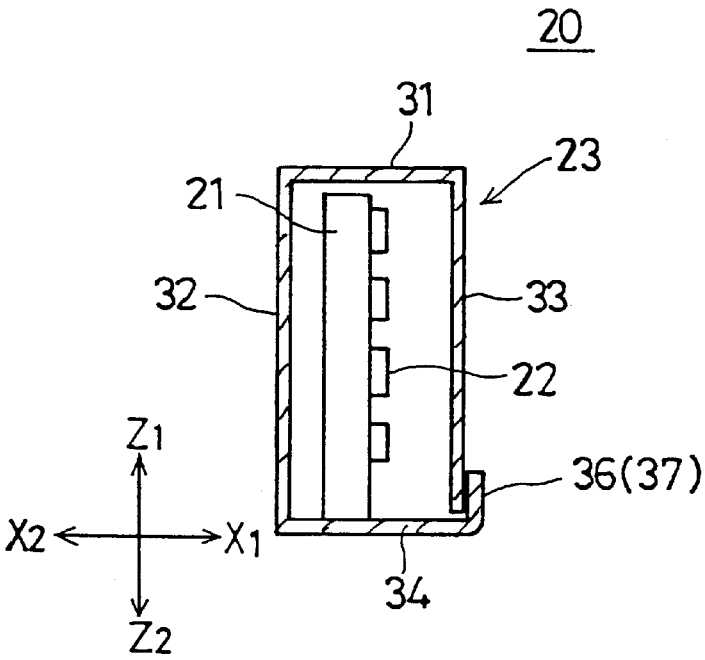
FIG. 3 is a cross-sectional view along a line III of the USB connector shown in FIG. 2.
Figure 4:
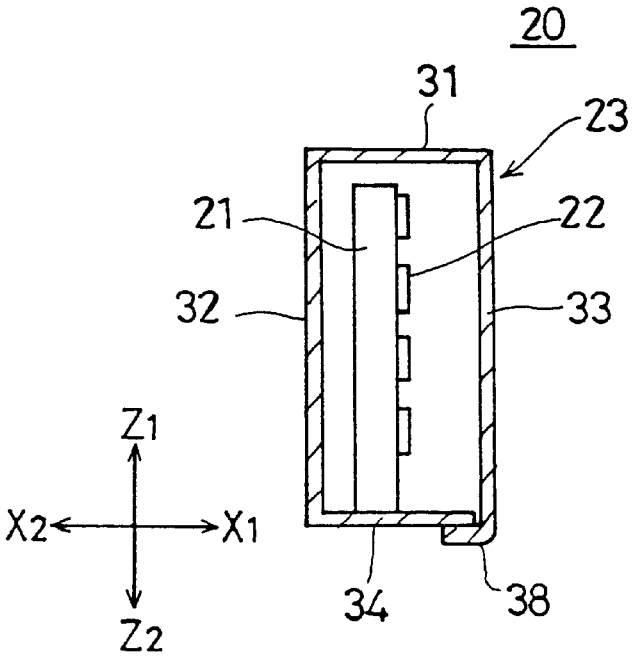
FIG. 4 is a cross-sectional view along a line IV of the USB connector shown in FIG. 2.

As additionally shown in FIG. 3, the bottom portion 34 and the right side wall portion 33 are joined so that two engaging tabs 36 and 37 (of which only engaging tab 36 can be seen from the angle presented in FIG. 3) extending from and bent upward at a right angle to the bottom portion 34 engage a portion of an outer surface of the right side wall portion 33 near the cable connector insertion port 24, in such a way as to restrict a lateral displacement in an X1 direction of a bottom edge of the right side wall portion 33 with respect to the bottom portion 34. Additionally, as shown in FIG. 4, an engaging tab 38 extending from and bent at a right angle to the right side wall portion 33 engages a lower surface of the bottom portion 34 so as to restrict a displacement upward in a Z1 direction of the right side wall portion 33 with respect to the bottom portion 34.

The aforementioned engaging tabs 36 and 37 are actually tongue portions 30*d* and 30*e* projecting from a preformed bottom portion 30*c* and bent at right angles thereto. The engaging tab 38 is formed from a tongue portion 30*f* projecting from preformed right side wall portion 30*a* and bent at a right angle thereto.

Additionally, these three engaging tabs 36, 37 and 38 are disposed near the cable connector insertion port 24, with engaging tab 38 disposed between engaging tabs 36 and 37 in such a way as to increase the mechanical stability and rigidity of the joint section where the bottom portion 34 and the right side wall portion 33 meet.

Additionally, as mentioned previously, the legs 25 are formed so as to extend from the right side wall portion 33 and the left side wall portion 32 in a downward Z2 direction.

The fifth leg 27 is provided at a tip of a flap 28 bent backward in the rear Y1 direction from a front Y2 edge of the bottom portion 34. The flap 28 is formed from a tongue portion 30*g* extending forward from the front Y2 edge of the preformed bottom portion 30*c* of the metal sheet 30, with the fifth leg 27 formed from a tongue portion 30*h* extending forward in the Y2 direction from the tongue portion 30*g*. As will be explained later, this fifth leg serves to stabilize the mounting of the USB connector 20 on the printed circuit board 40 and to reinforce the mechanical stability and rigidity of the metal housing 23 in a state in which the metal housing 23 is mounted on the printed circuit board 40.

Figure 5:
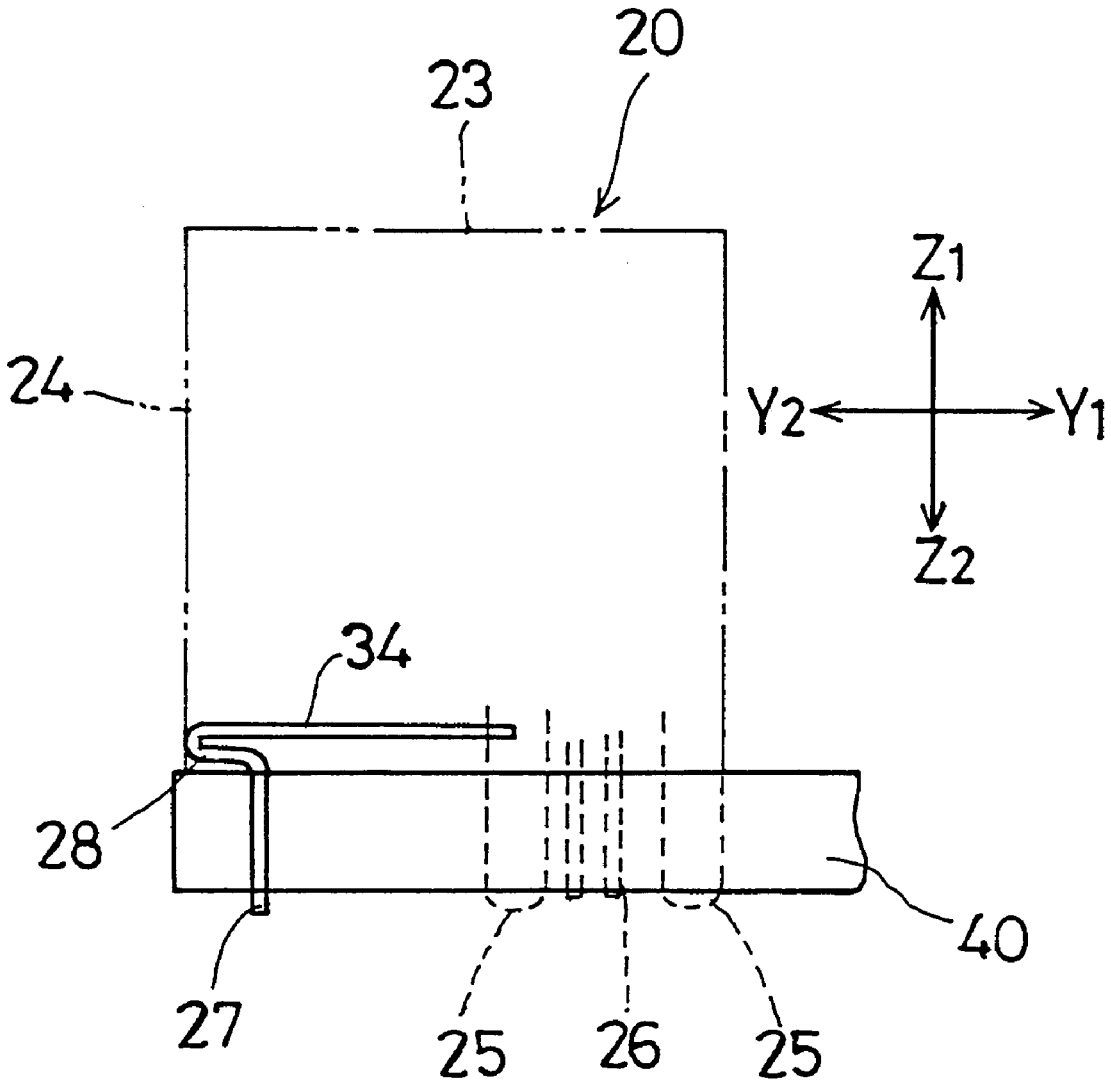
FIG. 5 is a diagram showing a state in which the USB connector shown in FIG. 2 is mounted on a printed circuit board.

When in a mounted state on a printed circuit board 40 as shown in FIG. 5, the terminals 26 of the above-described USB connector 20 penetrate through-holes 41, the legs 25 penetrate through-holes 42 and the fifth leg 27 penetrates a through-hole or slit 43, and in that state the terminals 26, legs 25 and fifth leg 27 are soldered to the printed circuit board 40.

It should be noted that the legs 25 are located toward the rear Y1 side of the USB connector, so in a state in which the USB connector 20 is provisionally mounted on the printed circuit board 40 the force of gravity would normally tend to tilt the USB connector 20 toward the front side, that is, the cable connector insertion port 24 side, of the USB connector 20. However, in the present embodiment a fifth leg 27 is present at the cable connector insertion port 24 side of the USB connector 20, so this cable connector insertion port 24 side of the USB connector 20 is supported by the flap 28 and the fifth leg 27 and therefore the USB connector 20 is positioned level as shown in FIG. 5. Accordingly, the USB connector 20 is mounted in a level position atop the printed circuit board 40, as shown in FIG. 5. In other words, the operation of correcting, that is, leveling, the position of the USB connector 20 in its provisionally mounted state atop the printed circuit board 40 before soldering is eliminated, and so the work of mounting the USB connector 20 on the printed circuit board 40 can proceed with greater speed and efficiency.

Additionally, when the USB connector 20 is mounted atop the printed circuit board 40, the mechanical stability and rigidity of the cable connector insertion port 24 portion of the metal housing 23 of the USB connector 20 is enhanced because the fifth leg 27 fixedly mounts the part of the bottom portion 34 of the USB connector 20 near the cable connector insertion port 24 on the printed circuit board 40.

This enhanced mechanical stability and rigidity is provided so that the cable connector insertion port 24 will not be deformed and the USB connector 20 will not be loosened from its mounted position atop the printed circuit board 40 by a force of insertion of the cable connector 10 in the cable connector insertion port 24 or by a force exerted on the USB connector 20 itself when the cable itself is accidentally pulled or wrenched.

Additionally, as mentioned previously, the USB connector 20 is mounted on the printed circuit board 40 inside the data device in such a way that the cable connector insertion port 24 is exposed to an opening in the side of the device itself for the insertion of a cable. So long as the USB connector 20 is in a level position the USB connector 20 does not contact an edge of the opening in the side of the device and thus no interference with the side of the device occurs. It will be appreciated that the cable connector 10 is inserted in and connected to this cable connector insertion port 24 of the USB connector 20.

The metal housing 23 is fixedly mounted at the rear Y1 side by the legs 25 and Is fixedly mounted at the front, that is, the cable connector insertion port 24, or Y2, side by the fifth leg 27, and is therefore mounted in a well-balanced state, such that the metal housing 23 does not move or shift with respect to the printed circuit board 40 but has instead enhanced mechanical stability compared to the conventional mounting. In particular, the cable connector insertion port 24 is more mechanically rigid compared to the conventional mounting, and thus able to withstand without deformation a greater degree of force exerted thereon by the accidentally pulling or wrenching of the cable than the conventional USB connector can do.

As a result, the work of inserting the cable connector 10 into the USB connector 20 proceeds quickly and smoothly.

Additionally, even if the cable connector 10 is wrenched or twisted during insertion or is accidentally pulled, the bottom edge of the right side wall portion 33 does not come loose from the bottom portion 34, the metal housing 23 does not deform and the cable connector insertion port 24 is not deformed or enlarged because the mechanical strength and rigidity of the cable connector insertion port 24 portion of the metal housing 23 is more capable of withstanding such force.

A description will now be given of a second embodiment of a USB connector according to the present invention, with reference to FIG. 6 and FIG. 7.

Figure 6:
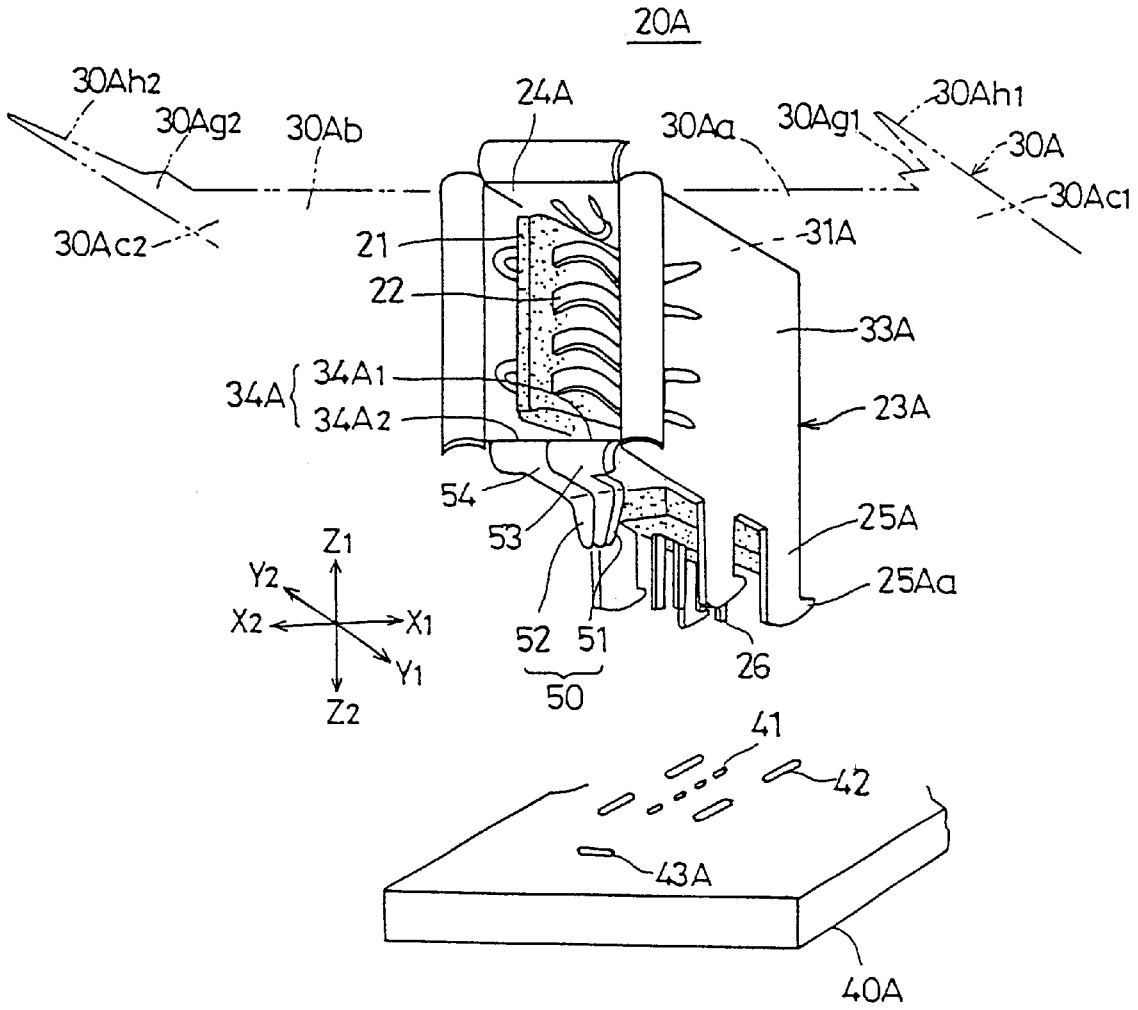
FIG. 6 is a diagram showing a second embodiment of a USB connector according to the present invention.

FIG. 6 is a diagram showing a second embodiment of a USB connector according to the present invention. FIG. 7 is a diagram showing a state in which the USB connector shown in FIG. 6 is mounted on a printed circuit board. In FIGS. 6 and 7, parts identical to parts shown in FIG. 2 are given identical reference numerals and a description thereof is omitted. Similarly, parts corresponding to parts shown in FIG. 2 are given corresponding reference numerals but with the letter A appended thereto.

Figure 7:
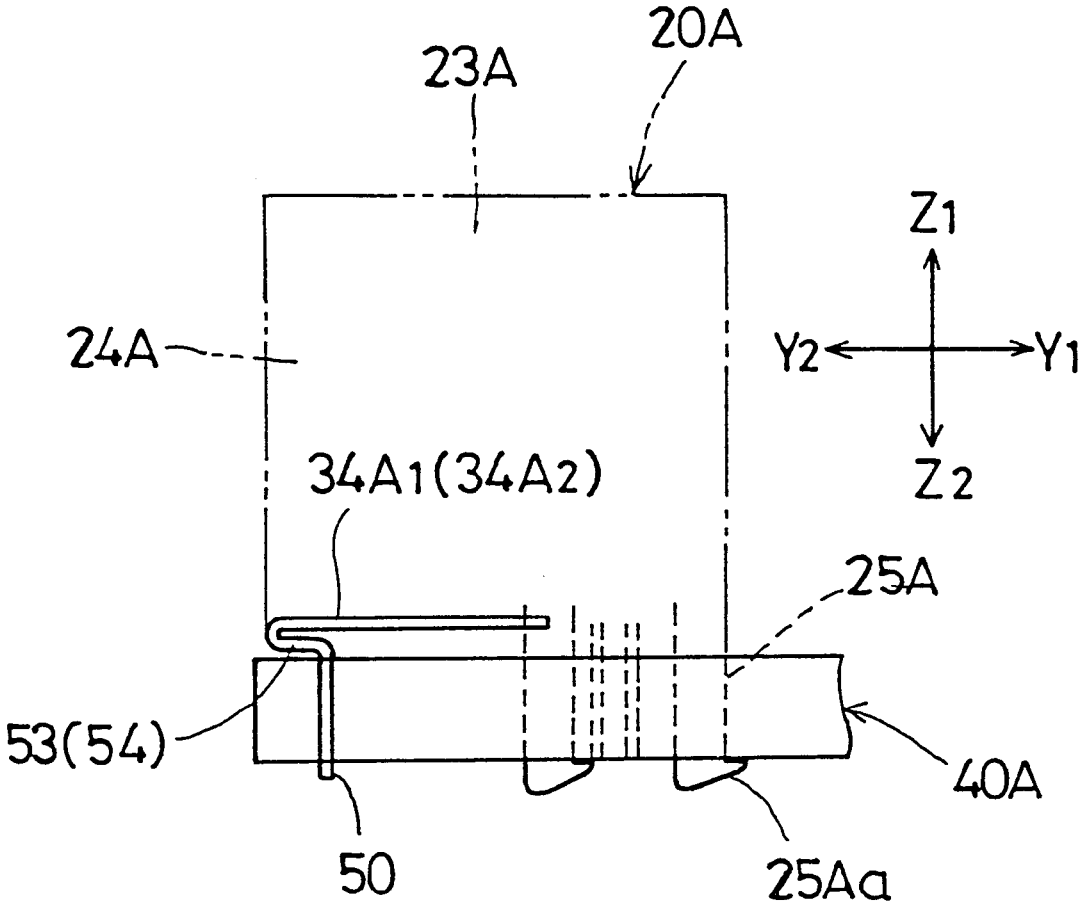
FIG. 7 is a diagram showing a state in which the USB connector shown in FIG. 6 is mounted on a printed circuit board.

The metal housing 23A of the USB connector 20A shown in FIGS. 6 and 7 differs from the metal housing 23 of the USB connector 20 shown in FIG. 2.

The metal housing 23A is formed by folding a metal sheet 30A depicted by the double-dotted-and-dashed line shown in FIG. 6, and comprises a top portion 31A, left and right side wall portions 32A and 33A, respectively, and a bottom portion 34A.

The metal sheet 30A indicated by the dotted-and-dashed lines is shown in the diagram so that a top portion thereof exactly coincides with the top portion 31A, and further comprises preformed right and left side wall portions 30A*a* and 30A*b*, respectively, as well as preformed bottom portions 30A*c*1 and 30A*c*2. The bottom portion 34A is formed by the joining of the two preformed bottom portions 30A*c*1 and 30A*c*2, each of which comprises one half of the bottom portion 34A. The metal housing 23A is formed by joining both side edges of metal sheet 30A at the center of the bottom portion 34A in the lateral X1–X2 direction, along the line in the longitudinal Y1–Y2 direction. The bottom portion 34A is formed from two bottom portion pieces 34A1 and 34A2, each of which comprises one lateral half of the bottom portion 34A in the X1 and X2 directions, respectively.

Reference numeral 50 is a fifth leg, and is composed of a pair of adjacent housing terminals housing terminals 51 and 52. Housing terminal 51 is disposed at a free end of flap 53 bent backward in a Y1 direction from a front Y2 edge of half bottom portion piece 34A1. Similarly, housing terminal 52 is disposed at a free end of flap 54 bent backward in the Y1 direction from the front Y2 edge of half bottom portion piece 34A2.

Fold 53 is formed from a tongue portion 30A*g*1 extending forward in the Y2 direction from the front Y2 edge of preformed bottom portion 30A*c*1, with housing terminal 51 being formed from a tongue portion 30A*h*1 extending forward in the Y2 direction from tongue portion 30A*g*1. Fold 54 is formed from a tongue portion 30A*g*2 extending forward in the Y2 direction from the front Y2 edge of preformed bottom portion 30A*c*2, with housing terminal 52 being formed from a tongue portion 30A*h*2 extending forward in the Y2 direction from tongue portion 30A*g*2. Accordingly, housing terminal 51 is connected to half bottom portion piece 34A1 and housing terminal 52 is connected to half bottom portion piece 34A2.

Additionally, the metal housing 23A has legs 25A. The lower tips of the legs 25A have hooks 25A*a* extending rearward in the Y1 direction.

As shown in FIG. 6, in the USB connector 20A having the structure described above, the terminals 26 engage through-holes 41, the legs 25A engage through-holes 42 and the front leg 50 engages a through-hole 43A, and in that state the USB connector 20A is provisionally mounted on the printed circuit board 40A, and in that provisionally mounted state the terminals 26, legs 25A and front leg 50 are soldered to the printed circuit board 40A so as to permanently mount the USB connector 20A on the printed circuit board 40A.

The fifth leg 50 is positioned near the cable connector insertion port 24A and, further, as noted previously, the pair of housing terminals 51 and 52 that together form the fifth leg 50 are engagingly inserted in the single through-hole 43A and soldered thereto. As a result, the metal housing 23A in general, and the cable connector insertion port 24 portion in particular, acquire enhanced mechanical stability and rigidity by the joining of the two half-bottom portion pieces 34A1 and 34A2, such as to withstand a lateral force exerted during connection of the cable connector 10 so that the metal housing 23A does not come apart.

Additionally, the metal housing 23A is fixedly mounted on the printed circuit board 40 at a portion near the cable connector insertion port 24A, so the cable connector insertion port 24A side of the USB connector 20A is more rigidly mounted than is the case when the metal housing 23A Is fixedly mounted toward the rear Y1 side using the legs 25A alone. As a result, the work of inserting and connecting the connector cable 10 in the USB connector 20A can proceed efficiently and smoothly.

Additionally, in a state in which the USB connector 20A is provisionally mounted on the printed circuit board 40 as shown in FIG. 7, hook portions 25A*a* on the lower tips of the legs 25A engage a lower surface of the printed circuit board 40 and the flaps 53 and 54 of the fifth leg 50 support the cable connector insertion port 24A side.

As a result, the typical downward tilt of the cable connector insertion port 24A side of the USB connector 20A is restricted and the USB connector 20A thus assumes the level position shown in FIG. 7. Accordingly, the USB connector 20A is fixedly mounted in a level position atop the printed circuit board 40 as shown in FIG. 7 even without any correction of the position of the USB connector 20A when the USB connector 20A is provisionally mounted on the printed circuit board 40.

A description will now be given of a third embodiment of a USB connector according to the present invention, with reference to FIG. 8 and FIG. 9.

Figure 8:
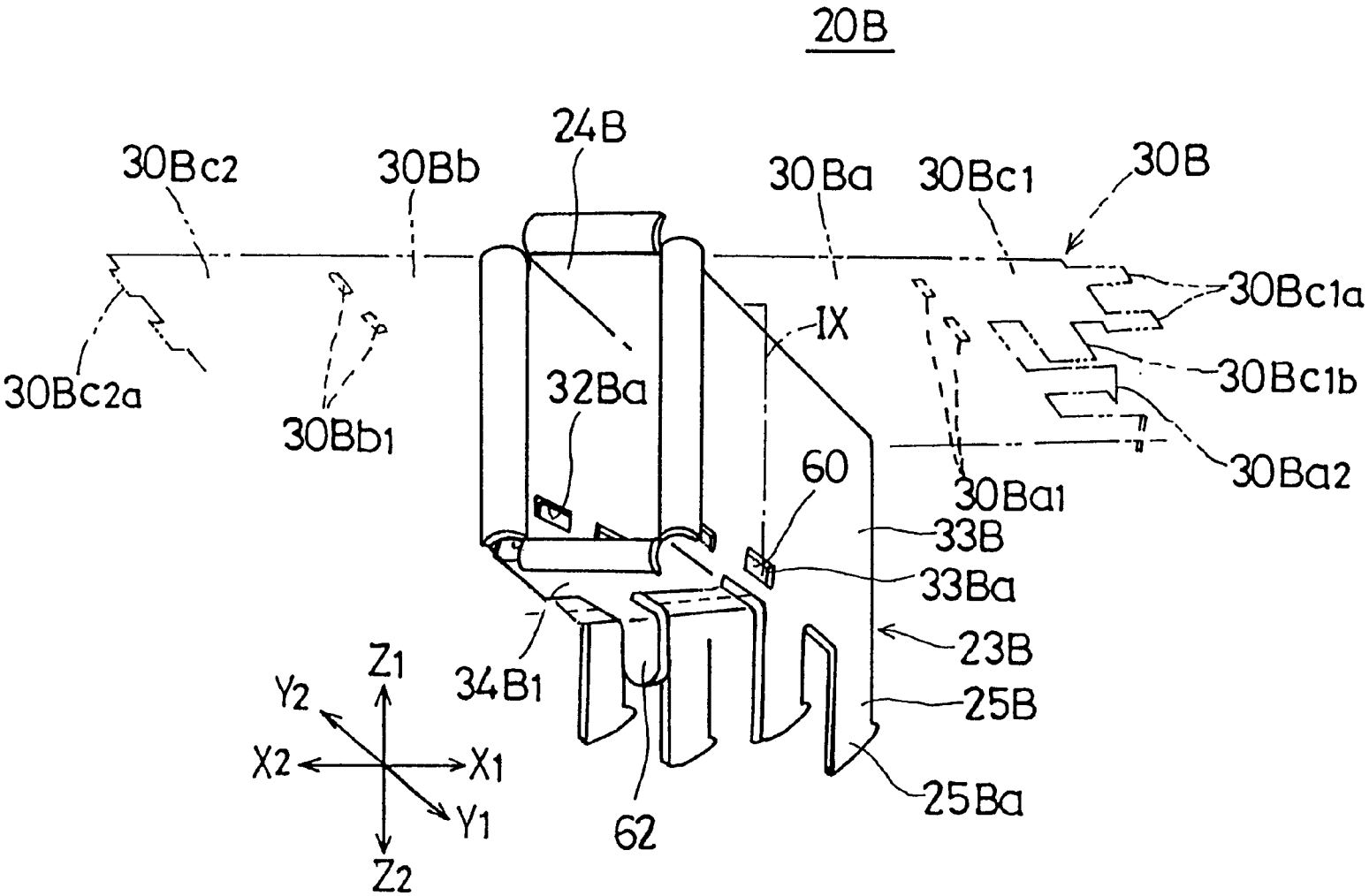
FIG. 8 is a diagram of a third embodiment of a USB connector according to the present invention.

FIG. 8 is a diagram of a third embodiment of a USB connector according to the present invention. FIG. 9 is a cross-sectional view along a line IX of the USB connector shown in FIG. 8. In FIGS. 8 and 9 parts identical to parts shown in FIG. 2 are given identical reference numerals and a description thereof is omitted. Similarly, parts corresponding to parts shown in FIG. 2 are given corresponding reference numerals but with the letter B appended thereto.

Figure 9:
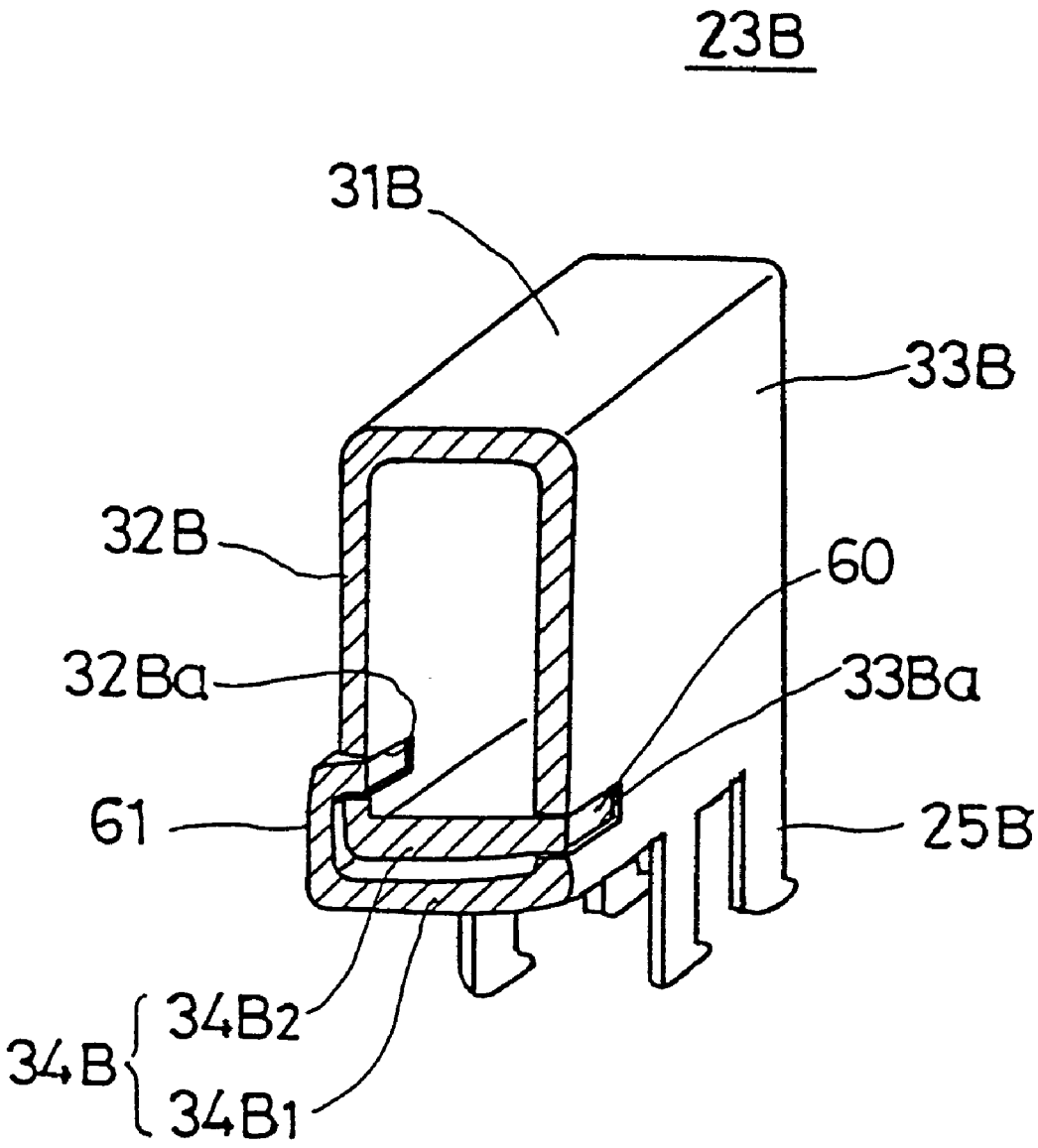
FIG. 9 is a cross-sectional view along a line IX of the USB connector shown in FIG. 8.

The metal housing 23B of the USB connector 20B shown in FIGS. 8 and 9 differs from the metal housing 23 of the USB connector 20 shown in FIG. 2.

The metal housing 23B is formed by folding a metal sheet 30B depicted by the double-dotted-and-dashed line shown in FIG. 8, and comprises a top portion 31B, left and right side wall portions 32B and 33B, respectively, and a bottom portion 34B. The bottom portion 34B is of two-ply construction and thus forms a double bottom, comprising lower bottom portion 34B1 and upper bottom portion 34B2.

The metal sheet 30B indicated by the dotted-and-dashed lines is shown in the diagram so that a top portion thereof exactly coincides with the top portion 31B, and further comprises preformed right and left side wall portions 30B*a* and 30B*b*, respectively, as well as preformed lower and upper bottom portions 30B*c*1 and 30B*c*2, respectively, which are continuations of the preformed right and left side wall portions 30B*a* and 30B*b*, respectively.

Two outwardly convex projections 60 formed at the front edge of the upper bottom portion 34B2 engage slots 33B*a* formed in the right side wall portion 33B from the inside thereof. The lower bottom portion 34B1 is positioned directly below the upper bottom portion 34B2. Two C-shaped portions 61, formed by bending an edge of the lower bottom portion 34B1 first upward in a Z1 direction and then laterally inward in the X1 direction, engage an outer surface near the bottom edge of the left side wall portion 32B and further engage slots 32B*a* in the left side wall portion 32B from outside the left side wall portion 32B. As a result, the conjunction of the lower bottom portion 34B1 and the left side wall portion 32B is strengthened and the metal housing 23B itself acquires enhanced mechanical stability and rigidity.

The C-shaped portions 61 are themselves formed from tongue portions 30B*c*1*a* extending from preformed lower bottom portion 30B*c*1. The two projections 60 are formed from tongue portions 30B*c*2*a* extending from preformed upper bottom portion 30B*c*2. Hole 30B*a*1 forms slot 33B*a* and hole 30B*b*1 forms slot 32B*a*.

Additionally, reference numeral 62 is the fifth leg and extends from the lower bottom portion 34B1 in the downward Z2 direction. This fifth leg 62 is formed from a tongue portion 30B*c*1*b* extending from preformed lower bottom portion 30B*c*1.

Additionally, the metal housing 23B has legs 25B. The lower tip of each of the legs 25B has a hook portion 25B*a* extending rearward in the Y1 direction. The legs 25B are formed from a tongue portion 30B*a*2 extending from preformed right side wall portion 30B*a*.

As described above, the USB connector 20B is mounted on the printed circuit board 40 in a well-balanced state using the fifth leg 62 as well, with the cable connector insertion port 24B of the metal housing 23B acquiring mechanical stability and rigidity thereby.

A description will now be given of a fourth embodiment of a USB connector according to the present invention, with reference to FIG. 10, FIG. 11 and FIG. 12.

Figure 10:
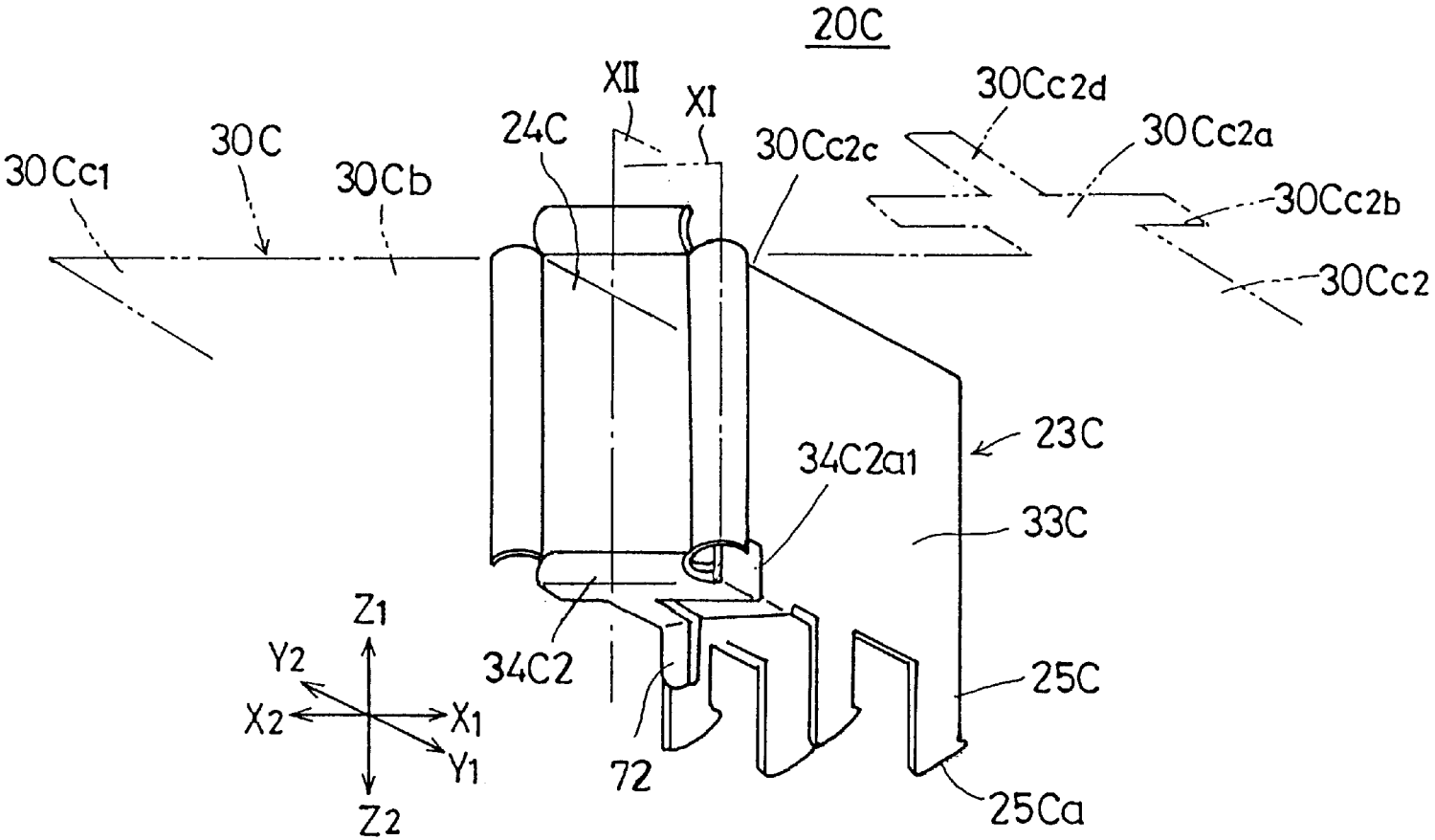
FIG. 10 is a diagram of a fourth embodiment of a USB connector according to the present invention.

FIG. 10 is a diagram of a fourth embodiment of a USB connector according to the present invention. FIG. 11 is a cross-sectional view along a line XI of the USB connector shown in FIG. 10. FIG. 12 Is a cross-sectional view along a line XII of the USB connector shown in FIG. 10. In FIGS. 10, 11 and 12, parts identical to parts shown in FIG. 2 are given identical reference numerals and a description thereof is omitted. Similarly, parts corresponding to parts shown in FIG. 2 are given corresponding reference numerals but with the letter C appended thereto.

For convenience, the insulation member and the right-angle contact terminals have been omitted from the drawings.

Figure 11:
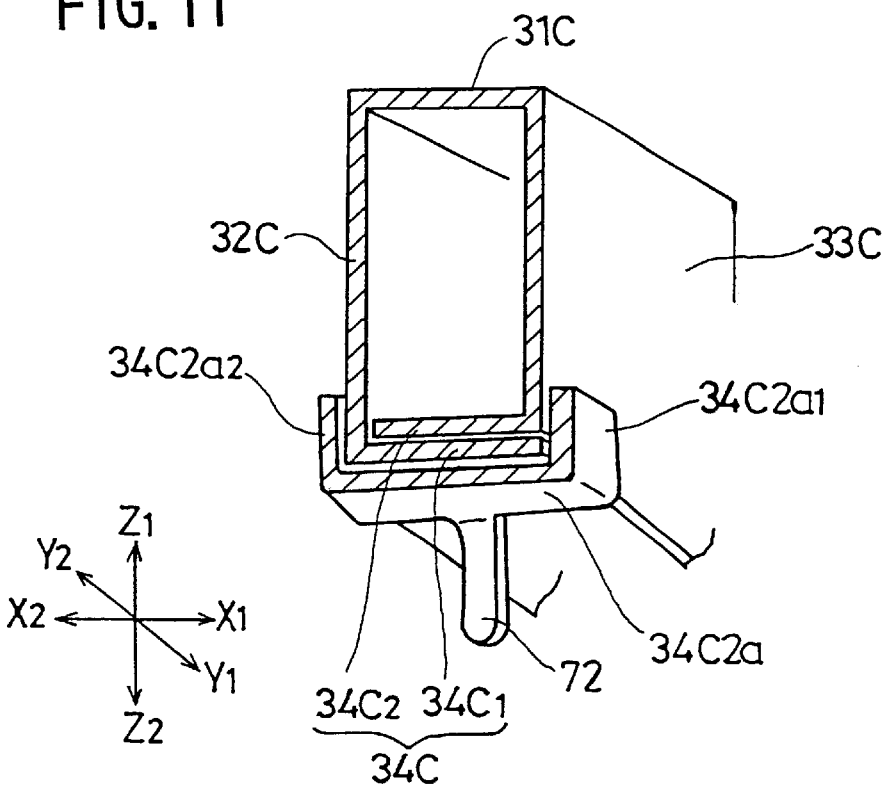
FIG. 11 is a cross-sectional view along a line XI of the USB connector shown in FIG. 10.
Figure 12:
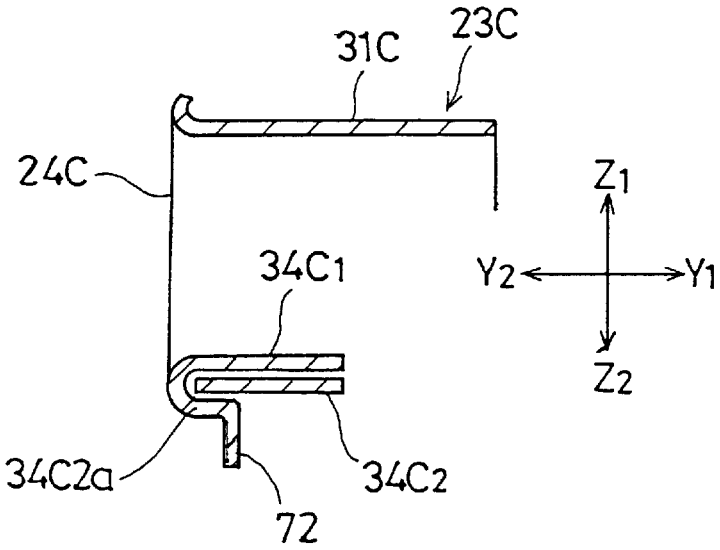
FIG. 12 is a cross-sectional view along a line XII of the USB connector shown in FIG. 10.

The metal housing 23C of the USB connector 20C shown in FIGS. 10, 11 and 12 differs from the metal housing 23 of the USB connector 20 shown in FIG. 2.

The metal housing 23C is formed by folding a metal sheet 30C depicted by the double-dotted-and-dashed line shown in FIG. 10, and comprises a top portion 31C, left and right side wall portions 32C and 33C, respectively, and a bottom portion 34C.

The bottom portion 34C is of two-ply construction and thus forms a double bottom, comprising lower bottom portion 34C1 and upper bottom portion 34C2.

The metal sheet 30C indicated by the double-dotted-and-dashed lines is shown in the diagram so that a top portion thereof exactly coincides with the top portion 31C, and further comprises preformed right and left side wall portions 30C*a* and 30C*b*, respectively, as well as preformed lower and upper bottom portions 30C*c*1 and 30C*c*2, respectively, which are continuations of the preformed right and left side wall portions 30C*a* and 30C*b*, respectively.

A flap portion 34C2*a* is formed projecting forward from a front Y2 edge of the upper bottom portion 34C2, then bent downward in a Z2 direction and rearward in a Y1 direction. This flap portion 34C2*a* is positioned beneath the lower bottom portion 34C1. As shown in FIG. 11, a right side engaging part 34C2*a*1 and a left side engaging part 34C2*a*2 are bent upward in a Z1 direction at right angles from right and left side X1–X2 edges of the flap portion 34C2*a*. The right side engaging part 34C2*a*1 engages an outer surface of the right side wall portion 33C and the left side engaging part 34C2*a*2 engages an outer surface of the left side wall portion 32C, so that left and right side wall portions 32C and 33C are joined more strongly than has conventionally been the case. Accordingly, the metal housing 23C itself has improved mechanical stability and rigidity even prior to mounting on the printed circuit board 40. Additionally, a fifth leg 72 extends downward in the Z2 direction from the flap portion 34C2*a*.

It should be noted that the flap portion 34C2*a* is formed from a tongue portion 30C*c*2*a* extending forward from a front Y2 edge of the preformed upper bottom portion 30C*c*2. The engaging part 34C2*a*1 is formed from a tongue portion 30C*c*2*b* extending laterally in the X1 direction from the tongue portion 30C*c*2. The fifth leg 72 is formed by a tongue portion 30C*c*2*d* extending in the forward Y2 direction from the tongue portion 30C*c*2*a*.

Additionally, the metal housing 23C has legs 25C. The lower tips of the legs 25C have hooks 25C*a* extending rearward in the Y1 direction.

As described above, the USB connector 20C is mounted on the printed circuit board 40 in a well-balanced state using the fifth leg 72 as well, with the cable connector insertion port 24C of the metal housing 23C acquiring mechanical stability and rigidity thereby.

A description will now be given of a fifth embodiment of a USB connector according to the present invention, with reference to FIG. 13.

Figure 13:
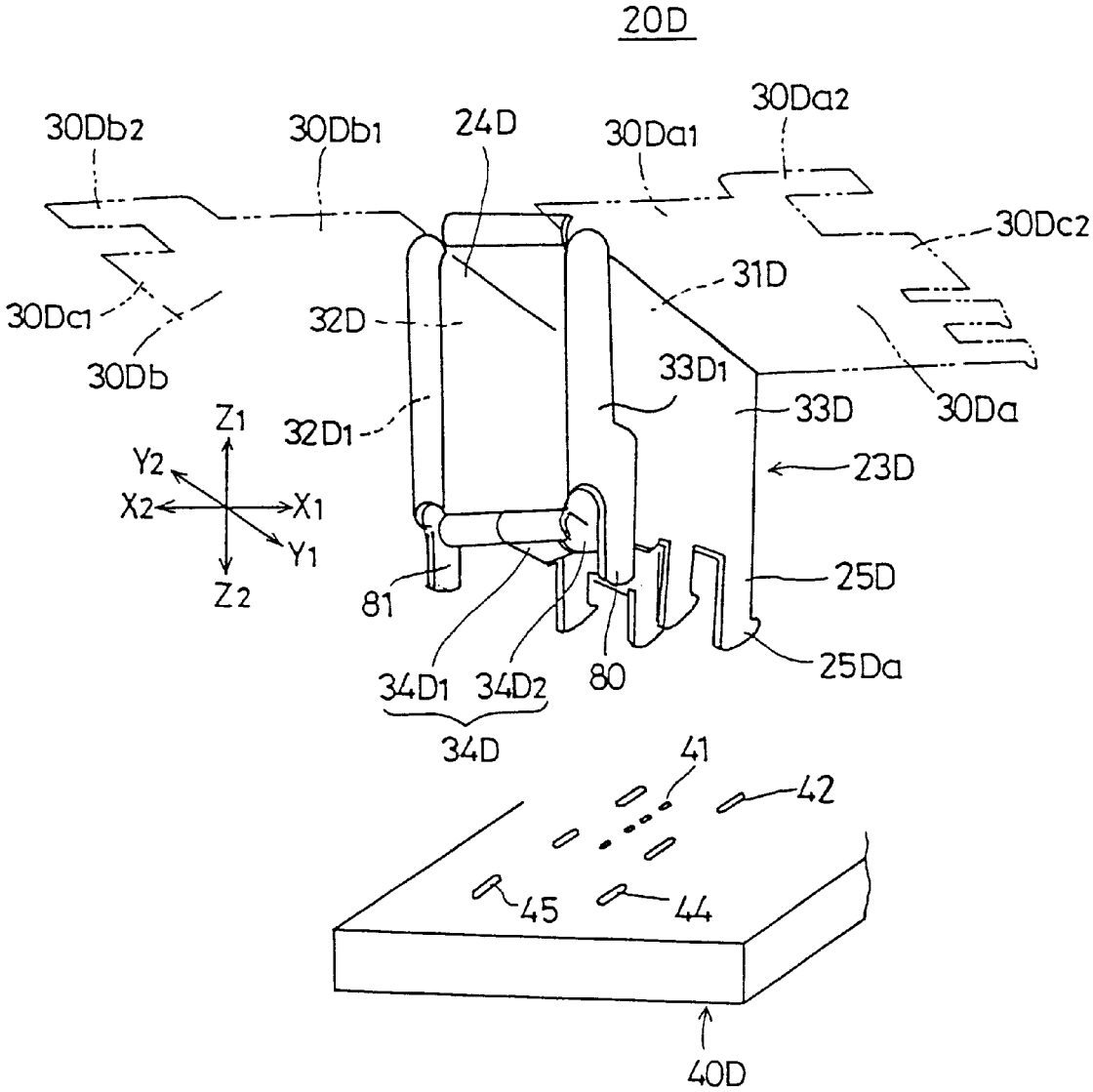
FIG. 13 is a diagram of a fifth embodiment of a USB connector according to the present invention.

FIG. 13 is a diagram of a fifth embodiment of a USB connector according to the present invention. In FIG. 13, parts identical to parts shown in FIG. 2 are given identical reference numerals and a description thereof is omitted. Similarly, parts corresponding to parts shown in FIG. 2 are given corresponding reference numerals but with the letter D appended thereto.

For convenience, the insulation member and the right-angle contact terminals have been omitted from the drawing.

The metal housing 23D of the USB connector 20D shown in FIG. 13 differs from the metal housing 23 of the USB connector 20 shown in FIG. 2.

The metal housing 23D is formed by folding a metal sheet 30D depicted by the double-dotted-and-dashed line shown in FIG. 13, and comprises a top portion 31D, left and right side wall portions 32D and 33D, respectively, and a bottom portion 34D.

The bottom portion 34D is formed from two bottom portion pieces 34D1 and 34D2, each of which comprises one lateral half of the bottom portion 34D in the X1 and X2 directions, respectively.

The metal sheet 30D indicated by the dotted-and-dashed lines is shown in the diagram so that the top portion thereof exactly coincides with the top portion 31D, and further comprises preformed right and left side wall portions 30D*a* and 30D*b*, respectively, as well as preformed half bottom portion 30D*c*1 continuing from preformed left side wall portion 30D*b* and preformed half bottom portion 30D*c*2 continuing from preformed right side wall portion 30D*a*.

The metal housing 23D has front legs 80, 81 at right and left sides of a cable connector insertion port 24D. The right leg 80 is formed so as to project in a downward Z2 direction from a flap portion 33D1 initially projecting forward from a front Y2 edge of the right side wall portion 33D and then bent backward toward a rear Y1 direction. Similarly, the left leg 81 is formed so as to project downward in the Z2 direction from a flap portion 32D1 initially projecting forward from the front Y2 edge of the left side wall portion 32D and then bent backward therefrom toward the rear Y1 direction.

A tongue portion 30D*a*1 extending from the front Y2 edge of the preformed right side wall portion 30D*a* forms the flap portion 33D1, with a tongue portion 30D*a*2 extending from the tongue portion 30D*a*1 forming a reinforcing terminal 80. Similarly, a tongue portion 30D*b*1 extending from the front Y2 edge of the preformed left side wall portion 30D*b* forms the flap portion 32D1, with a tongue portion 30D*b*2 extending from the tongue portion 30D*b*1 forming a reinforcing terminal 81.

Additionally, the metal housing 23D has legs 25D. The lower tips of the legs 25D have hooks 25D*a* extending rearward in the Y1 direction.

With the USB connector 20D as described above, the legs 25D engage through-holes 42, the right front leg 80 engages a through-hole 44 and the left front leg 81 engages a through-hole 45, with these legs being soldered to their respective through-holes so as to mount the USB connector 20D on the printed circuit board 40. Accordingly, in a mounted state the right front leg 80 and the left front leg 81 function jointly to restrict any outward expansion of the cable connector insertion port 24D side of the left and right side wall portions 32D and 33D of the USB connector 20D.

It should be noted that the present invention is not limited to a USB connector 20 but can be applied to any electrical connector having a metal shield member.

The above description is provided in order to enable any person skilled in the art to make and use the invention and sets forth the best mode contemplated by the inventors of carrying out the invention.

The present invention is not limited to the specifically disclosed embodiments and variations, and modifications may be made without departing from the scope of the present invention.

The present application is based on Japanese Priority Application No. 11-168396, filed on Jun. 15, 1999, the entire contents of which are hereby incorporated by reference.

What is claimed is:

1. A connector comprising:

a contact terminal member;

a housing formed from a single sheet of metal and having top, side wall and bottom portions so as to form a box enclosing said contact terminal member, said bottom portion being a double bottom portion having an upper bottom portion and a lower bottom portion reinforcingly disposed to engage each other, a free end of said lower bottom portion being bent upward and then backward so as to have a substantially C-shaped cross section, an upper part of said C-shaped cross section engaging a slot formed in said side wall portion of said housing;

a cable connector insertion port formed at a front end of said housing;

a plurality of legs integrally formed with said housing and disposed so as to extend in a downward direction from side rear edges of said bottom portion of said housing, said legs to be inserted in a plurality of holes formed on a printed circuit board; and a front leg integrally formed with said housing and disposed so as to extend in a downward direction from a bottom edge of said housing, said front integrated leg to be inserted in a hole formed on said printed circuit board so as to fixedly mount a front end of said connector on said printed circuit board.

2. The connector as claimed in claim 1, wherein said connector is a Universal Serial Bus (USB) connector.

3. The connector as claimed in claim 1, wherein said connector has a plurality of front legs integrally formed with said housing and extending downward from said bottom edge of said housing, said legs being inserted in a plurality of holes formed on said printed circuit board so as to fixedly mount said front end of said connector on said printed circuit board.

4. A connector comprising:

a contact terminal member;

a housing formed from a single sheet of metal and having top, side wall and bottom portions so as to form a box enclosing said contact terminal member, said bottom portion being a double bottom portion having an upper bottom portion and a lower bottom portion reinforcingly disposed to engage each other;

a cable connector insertion port formed at a front end of said housing;

a plurality of legs integrally formed with said housing and disposed so as to extend in a downward direction from side rear edges of said bottom portion of said housing, said legs to be inserted in a plurality of holes formed on a printed circuit board; and a front leg integrally formed with said housing and disposed so as to extend in a downward direction from a bottom edge of said housing, said front integrated leg to be inserted in a hole formed on said printed circuit board so as to fixedly mount a front end of said connector on said printed circuit board;

wherein a front edge of said upper bottom portion extends beyond said bottom edge of said cable connector insertion port and then bends downward and rearward so as to form a flap portion which extends rearward along an outer surface of said lower bottom portion, a tip portion of said flap portion being formed into an integrated leg extending downward therefrom, said integrated leg to be inserted in a hole formed in said printed circuit board so as to fixedly mount said front end of said connector on said printed circuit board.

5. The connector as claimed in claim 4, wherein said flap portion has flange portions on either side thereof, said flange portions being bent upward so as to extend along an outer surface of both side wall portions of said housing.

6. The connector as claimed in claim 4, wherein said connector has a plurality of front legs integrally formed with said housing and extending downward from said bottom edge of said housing, said legs being inserted in a plurality of holes formed on said printed circuit board so as to fixedly mount said front end of said connector on said printed circuit board.

7. The connector as claimed in claim 4, wherein said connector is a Universal Serial Bus (USB) connector.

* * * * *